US005328191A

United States Patent [19]

Taylor, Jr.

[11] Patent Number: 5,328,191

[45] Date of Patent: Jul. 12, 1994

[54] GAME PROJECTILE AND METHOD OF PLAYING A GAME

[76] Inventor: Douglas W. Taylor, Jr., 3319 Oak Knoll, Brighton, Mich. 48116

[21] Appl. No.: 85,753

[22] Filed: Jun. 30, 1993

[51] Int. Cl.[5] ..... A63B 37/06; A63B 37/12; A63B 71/02

[52] U.S. Cl. ..... 273/411; 283/58 A; 283/415; 283/428

[58] Field of Search ..... 273/411, 415, 428, 58 R, 273/58 A

[56] References Cited

U.S. PATENT DOCUMENTS

| | | | |
|---|---|---|---|
| 265,487 | 10/1882 | Cureton | 273/58 C |
| 929,013 | 7/1909 | Reach | 273/58 A |
| 1,031,671 | 7/1912 | Barbour | 273/58 A |
| 1,106,978 | 8/1914 | Shibe | 273/58 A |
| 1,438,573 | 12/1922 | Barkley | 273/58 A |
| 2,081,531 | 10/1935 | Fegan | 273/58 A |
| 2,086,094 | 7/1936 | Reach | 273/58 A |
| 3,518,786 | 7/1970 | Holtvoigt | 273/58 A |
| 3,851,880 | 12/1974 | Ritch | 273/58 A X |
| 3,924,856 | 12/1975 | Dekan et al. | 273/415 |
| 3,927,882 | 12/1975 | Galarza | 273/58 A X |
| 3,997,164 | 12/1976 | White, Sr. | 273/128 R |
| 4,011,611 | 3/1977 | Lederman | 5/361 B |
| 4,151,994 | 5/1979 | Stalberger, Jr. | 273/58 A |
| 4,463,951 | 8/1984 | Kumasaka et al. | 273/58 A |

*Primary Examiner*—William H. Grieb
*Attorney, Agent, or Firm*—Brooks & Kushman

[57] ABSTRACT

The present invention describes a game projectile having an energy dissipative core having an irregular shape, a pliant moisture-resistant cover enclosing said core to form an irregularly-shaped inner body and a pliant, substantially puncture-resistant, exterior casing enveloping said inner body. The game projectile is used to play a soccer-like game on ice.

25 Claims, 2 Drawing Sheets

GAME PROJECTILE AND METHOD OF PLAYING A GAME

TECHNICAL FIELD

The present invention relates to a new game and method of playing same and, in particular, to a new game projectile for use with the new game.

BACKGROUND ART

Traditional outdoor winter games on ice such as ice hockey and ice skating depend upon reasonably favorable ice surfaces.

The traditional game of ice hockey requires at a minimum, hockey skates, hockey sticks, a hockey puck and goal structures. In addition, the hockey playing field preferably is encircled by a wall to keep the puck in play on the ice. Without this wall, the hockey puck travels great distances when struck reasonably hard by the hockey player.

In playing the game of ice hockey on frozen lakes, it is necessary to create some wall or barricade around the hockey playing field to keep the puck from traveling too far. If snow is present on the frozen lake, snow can be used to form adequate barriers or walls around the periphery of the hockey playing field to limit the travel of the hockey puck outside the playing area. In addition, the playing of ice hockey on frozen lakes requires a relatively smooth frozen ice surface for skating and adequate control of the hockey puck during play.

In contrast, the game of soccer requires a hard, non-slippery playing field. This non-slippery playing field is commonly a grass or astroturf surface. In playing soccer, nothing more is required except a soccer ball and goal structures. The soccer ball is typically an inflated, spherical ball.

Common to both traditional games, hockey and soccer, is a goal area or structure typically defined by two vertical poles and a horizontal pole forming a goal area with a net extending behind to catch either the hockey puck or the soccer ball. Backyard hockey and soccer enthusiasts often lack formal goal structures and instead use a pair of simple goal members spaced apart.

A typical indoor soccer ball is disclosed by Galarza in U.S. Pat. No. 3,927,882. Galarza's soccer ball is comprised of a solid spherical core of aluminum foil, an outer spherical core of plastic, two inner covers of thin knitted material and an outer cover of cotton or leather.

Ritch U.S. Pat. No. 3,851,880 discloses a hockey-type game apparatus wherein a hockey stick is fitted with a unique blade for hitting a dumbbell-shaped hockey projectile. The dumbbell-shaped hockey projectile is relatively lightweight and made of a resilient material.

Indoor soccer balls, as disclosed by Galarza are designed especially for playing the traditional game of soccer, and require a substantially spherical projectile that readily rolls on the ground or whatever surface is being utilized and has particularly low energy dissipative characteristics that allow rebounding of the ball after impact a great distance. In contrast, a hockey puck is a relatively solid projectile of a particular shape well suited for the game of hockey. The hockey puck travels relatively long distances when struck by a hockey stick while the puck is on ice.

The game projectile of the present invention is utilized with a new game that incorporates the playing surface and relative field size of hockey and modified rules of soccer. The new game incorporates a game projectile, which is not struck by a hockey stick or any similar game device, but is propelled by kicking, like a soccer ball. However, unlike a soccer ball, this projectile neither rolls nor has any rebounding characteristics. The object of the game, as in both hockey and soccer, is to advance the game projectile of the present invention across the playing field and into an opponent's goal area. The playing surface is contemplated as a surface of ice or other similar smooth hard slippery surface such as a resin covered gymnasium floor. Unlike hockey, however, a smooth, uniform ice condition is not required. One or more players per side make up opposing teams and attempt to propel the game projectile through the opponent's spaced apart goals.

SUMMARY OF THE INVENTION

The game projectile of the present invention is comprised of an energy dissipative core, a pliant moisture-resistant cover enclosing the core forming an irregularly-shaped inner body and a pliant substantially puncture-resistant exterior casing which envelops the inner body. The exterior casing loosely envelops the inner body, allowing the projectile to deform slightly when impacted by a player kicking the game projectile. The game projectile thus deforms and allows the projectile to slide and/or tumble on ice or some other smooth, hard, slippery surface, but not to roll when impacted. Hence, the projectile is kept in play when on the defined playing field.

The energy dissipative core is comprised of fabric, elastomeric or polymeric strips or pellets which provide the appropriate weight and bulk and which impart the proper playing characteristics. A moisture resistant cover encloses the core and forms an irregularly-shaped inner body. The irregularly-shaped inner body is then enveloped by the exterior casing to form the game projectile.

It is an object of the present invention to provide a game projectile for playing a new game on ice or some other similar smooth, hard, slippery playing surface which can be kicked about the playing field in a controllable manner by the players.

It is another object of the present invention to provide a game projectile which will enable sustained play of a new game on ice or on some other smooth, hard, slippery playing surface.

It is yet another object of the present invention to provide a game projectile for use with a new game on ice or some other smooth, hard, slippery playing surface which can be kicked about the playing field without substantially rolling on the playing surface.

It is still yet another object of the present invention to provide a game projectile for use with a new game to be played on ice or some other smooth, hard, slippery playing surface which has energy dissipative characteristics that allow the projectile to be kicked about the playing field without traveling great distances.

It is still a further object of the present invention to provide a game projectile which can be played on an ice playing field without collecting or retaining large amounts of water.

Yet another object of the present invention is to provide a game projectile which can withstand kicking at temperatures below 0° F. without splitting apart on impact.

It is yet a further object of the present invention to provide a game projectile which comprises an energy dissipative core, a pliant moisture-resistant cover enclosing the core forming an irregularly-shaped, but substantially defined, inner body and a pliant substantially puncture-resistant exterior casing enveloping the inner body.

It is still a further object of the invention to provide a method for playing a new soccer-like game on ice or some other smooth playing field including the steps of providing a game projectile of the present invention, providing boundary markers, a first and second pair of goal members, and rules for advancing said game projectile across the playing area and awarding points for moving the projectile through a pair of an opponent's goal members.

Other objects and advantages of the involved invention will become apparent from the following detailed description to be taken in conjunction with the accompanying drawings.

BEST MODE FOR CARRYING OUT THE INVENTION

Figure 1:
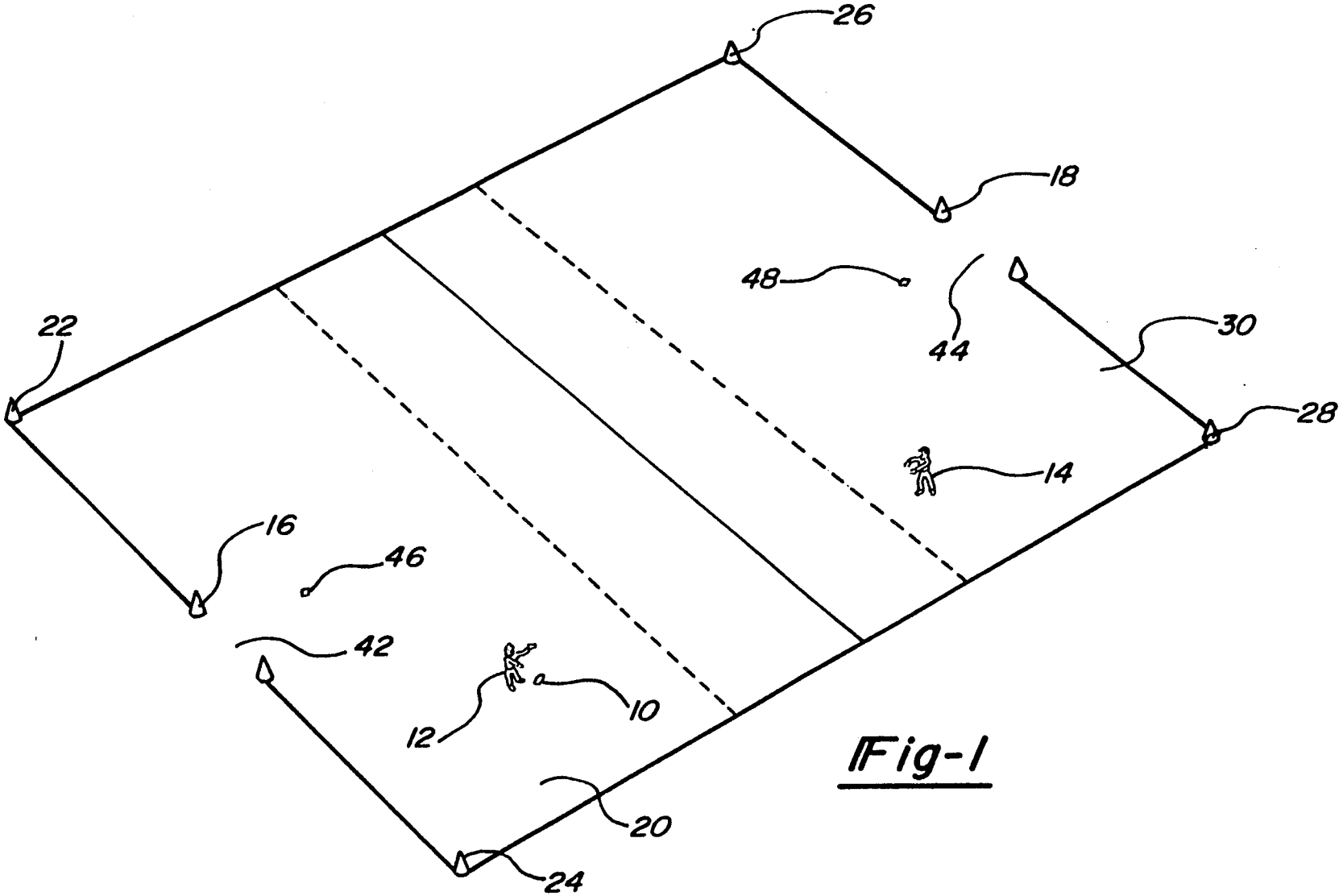
FIG. 1 is a perspective view of the playing field of the present invention.

FIG. 1 shows a perspective view of the playing field used in the playing of the game of the present invention. The playing field is contemplated as a relatively smooth surface such as an indoor ice arena, a frozen lake or pond or a substantially similar smooth, hard, slippery surface such as a waxed gymnasium floor. Game projectile 10 is illustrated between representative players 12 and 14. Also shown in FIG. 1 are goal members pairs 16 and 18 on a playing surface 20. Boundary markers 22, 24, 26, and 28 define the outer parameters of a playing area 30.

Figure 4:
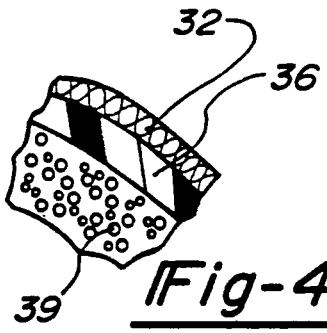
FIG. 4 is a fragmented, cross-sectional view of the game projectile of the present invention illustrating use of plastic pellets in the core.
Figure 3:
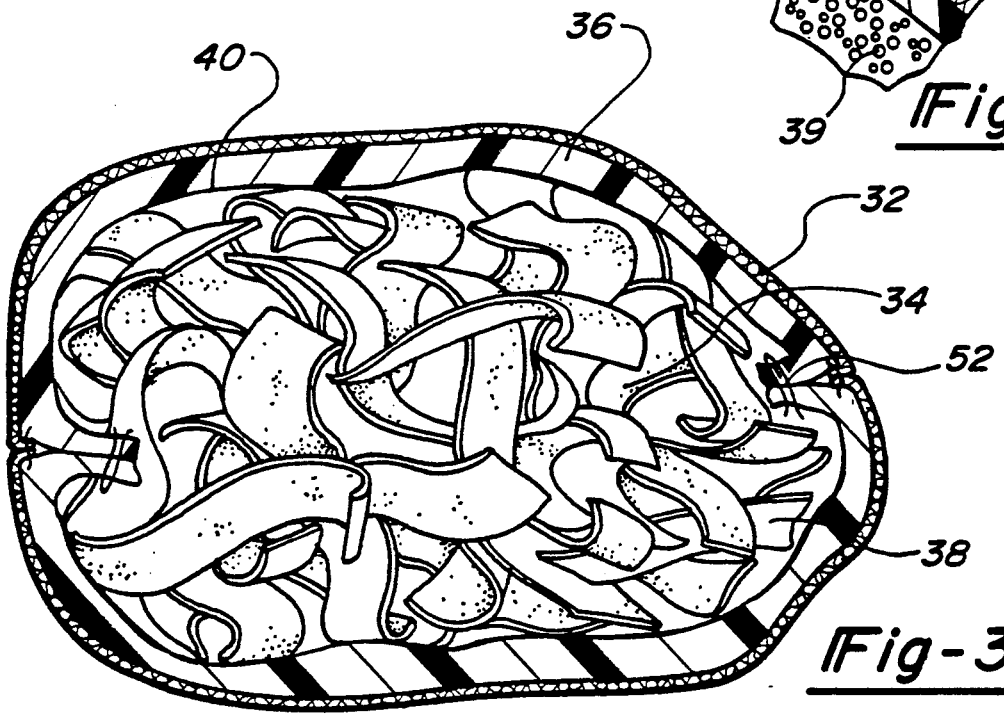
FIG. 3 is a cross-sectional view of the game projectile of the present invention taken along line 3—3 of FIG. 2.

The game projectile as shown in FIG. 3 includes an inner energy dissipative core 34 and a pliant moisture resistant cover 36 enclosing the core. In the preferred embodiment, the core 34 is comprised of a plurality of energy dissipative fabric strips 38. The fabric strips are designed in such a way that, if a puncture occurs in the game projectile after repeated play, the fabric strips 38 can be easily retrieved from the ice playing field or remain contained within the game projectile. These strips should be at least 2 inches long and 1 inch wide to facilitate easy removal of the strips from the playing surface, if by chance, both the exterior casing and core cover are punctured. This ease in removal from the playing field keeps the fast-paced nature of the game perpetuated by not slowing play to clean-up the field. The present invention contemplates using any form of fabric strip for example, natural, man-made, or synthetic fabrics. Other materials which provide the appropriate energy dissipative characteristics (i.e., elastomerics or polymerics, etc.) may be used. Other shapes such as a pellet form 39, may be used, as shown in FIG. 4.

The pliant, substantially moisture resistant, cover 36 loosely encloses the core and forms an irregularly-shaped inner body 40. The cover 36 must also be comprised of a non-brittle material. The irregularly-shaped inner body is generally elliptically spheroidal (pillow-shaped) but retains no specific shape. The shape of the inner body changes with each kicking or grasping of the game projectile.

The pliant moisture-resistant cover 36 is made from a polymeric, elastomeric, laminate or composite material such as plastic, rubber or a nylon material which will remain flexible at temperatures down to −10° F. and not become unnecessarily brittle or hard. A brittle surface will crack upon impact and allow water to seep into the inner core 34. The exterior casing material 32 must also be relatively pliant at low temperatures. It is essential that both the cover and exterior casing remain pliant to avoid foot injuries upon impact from kicking a game projectile that is too hard.

The cover 36 must be moisture-resistant or water impervious to keep the inner core 34 from soaking up too much moisture from the ice playing field. If the inner core 34 soaks up water from the playing field, the overall weight of the game projectile increases and the energy dissipative characteristics of the inner core are increased. As such, the game projectile 10 tends to travel less upon impact and lessens the particular playing characteristics of the present invention.

Figure 2:
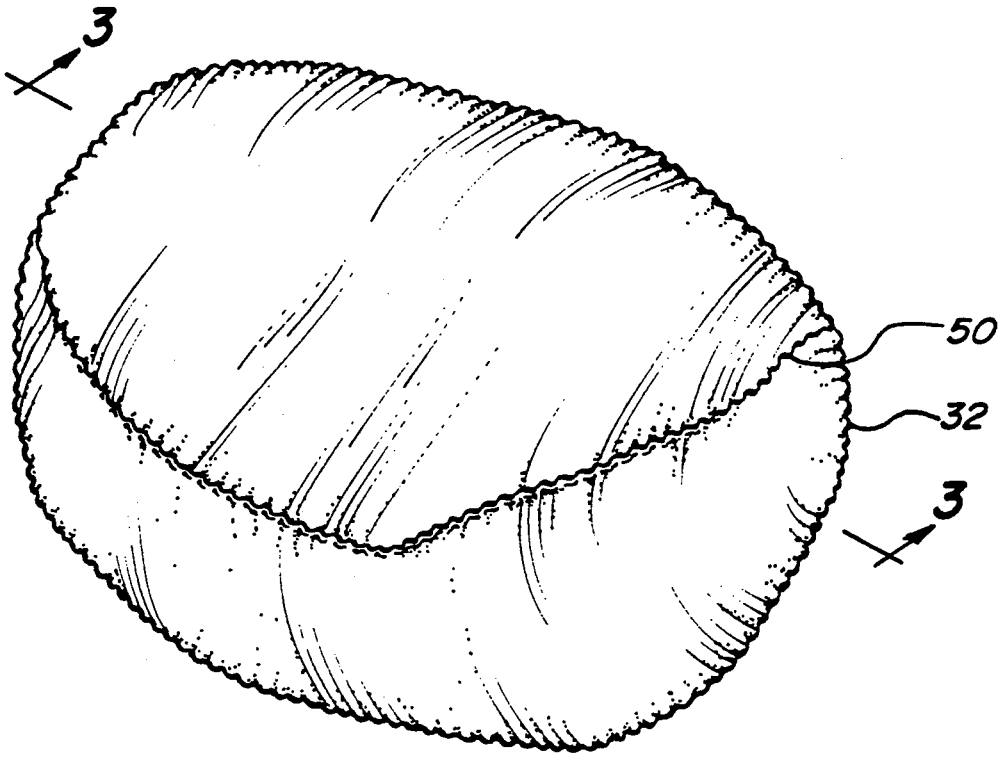
FIG. 2 is a perspective view of the game projectile of the present invention.

As shown in FIG. 2, game projectile 10 has a pliant rugged, exterior casing 32. This exterior casing 32 must be substantially puncture resistant to withstand repeated impact from kicking by various players. The exterior casing is made of a non-brittle material which can withstand the impact of repeated kicking by players at low temperatures.

The exterior casing 32 envelops the inner body relatively loosely to allow the game projectile to deform when impacted and to reduce the distance the game projectile moves upon impact. Thus, the loose fitting nature of both the exterior casing 32 and the cover 36 in combination with the elliptically spheroidal shape keeps the projectile from traveling too far when kicked on ice or a substantially slippery surface. The exterior casing 32 should envelop the inner body loosely enough that the projectile does not roll when impacted. Rather, the projectile slides and/or tumbles along the playing field after the kicking. Finally, because of the relatively loose fitting exterior casing, any player can grasp the game projectile with winter mittens or heavy gloves which are required because of the particularly low temperatures needed to play the game.

The exterior casing 32 is made of fiber based material such as canvas, burlap, corduroy or denim or some like material that will be rugged enough to withstand the impact of kicking, be able to be handled in cold temperatures, and still not retain large amounts of water. A polymeric or elastomeric material may also be used. It is contemplated that the exterior casing 32 and cover 36 can even be constructed of a laminate material (i.e. fabric bonded to rubber) with the exterior side (fabric portion) facing out away from said inner core.

Exterior casing 32 must provide substantial resistance to traveling rapidly on ice and also be capable of being grasped by the hands when the goalie is fielding a play or when any player is inbounding the projectile to resume play. Therefore, this casing should not be constructed of a material which does not allow easy grasping by the gloved hands of a player. The casing should therefore be constructed of a fabric, polymeric, elastomeric or laminate material.

In play, a particular predetermined shape or precise configuration of the projectile is not required. A partially deflated beachball-type shape is in fact conducive to playing the new game of the present invention. The overall horizontal girth of a projectile for adult play 18 to 42 inches and the vertical girth ranges from 12 to 36 inches. This configuration is for an adult version of the game projectile. The child version has a horizontal girth of 18 to 24 inches and a vertical girth of 12 to 18 inches.

The cover 36 of the present invention should be approximately 1–6 millimeters thick. The casing 32 of the present invention should be approximately 2–15 millimeters thick. The adult version of the game projectile 10 of the present invention should weigh approximately 4–8 pounds with an overall range (for both adult and child versions) of approximately 2–8 pounds. As such, the inner core 34 is comprised of fabric strips 38 of particular mass to allow the inner core 34 to be approximately 65–90% of the overall weight of the projectile. A projectile which is too heavy will be hard to kick and thus hard to propel around the playing field and this will slow play and limit the effectiveness of players who happen to be smaller, younger or older than other players. Conversely, a game projectile that is too light will also have undesirable playing characteristics.

The closure 50 of the exterior casing is done mechanically with a type of stitching which is sufficiently strong to withstand repeated impact from kicking the projectile back and forth across the playing surface. Double stitching with a heavy twine, monofilament line, nylon cord or nylon thread affords sufficient strength to withstand this repeated playing.

Cover closure 52 requires a substantially watertight characteristic, though being airtight is not required. A mechanical means of closure may be employed at this closure 52, or alternatively, adhesive bonding or heat treatment may be employed.

Attention is now directed to a method of playing the game of the present invention. Many new games emerge as a derivative or variation of some existing game or combination of games. Most emerging games are begun as "sand lot" or backyard activities which are adapted to space limitations, items or objects of play and numbers of participants. Formal rules, regulated equipment and league play on regulation-size playing fields often follow, usually with a speed in keeping with the proliferation and commercialization of the game.

The method of playing the game of the present invention begins with an outline of rudimentary points, but realizing that the basic play of soccer and the objective of that game apply. The substantial differences that exist between soccer and the present invention are the game projectile used and the surface of the playing field. Some of the rules of soccer, such as off-side situations and use of the head, are different.

The game of the present invention can be played in an informal manner with any number of players. In a regulation game, in an outdoor playing field or in an indoor hockey arena, a goalie and 8–10 other fielded players per team are contemplated. If the present invention is played on an indoor playing field with a substantially smooth surface such as a gymnasium floor, fewer players would be required.

At least four boundary markers 22, 24, 26, and 28 positioned as in FIG. 1, define a playing area 30 on the playing field 20 of between 190 to 210 feet long by 90 to 105 feet wide. As an indoor ice hockey rink is self-defined at approximately 190 feet, goal line to goal line, and 100 feet across, different variations of placement of the boundary markers would be required. Similarly, the defined dimensions of most indoor basketball courts, approximately 90 feet long by 49 feet wide would also require different placement of the markers, if this alternative surface is used.

A first pair of goal members 16 would be positioned on one end of the playing area as shown in FIG. 1 and a second pair of goal members 18 would be positioned on an opposite second end of the playing area. The goal member pairs 16 and 18 would be spaced approximately 8 feet apart and located directly on the goal lines on opposite ends of the playing area. The players would then be fielded, and advancement of the game projectile toward a selected one of the first and second goal members would be by use of a player's legs, torso, or upper-arms and not the use of the player's forearms, hands or head. Points would be awarded to a player, or a player's team by moving the game projectile through the opponent's selected pair of goal members (depending on what team is advancing the projectile) into the goal areas 42 and 44 respectively. The playing field 20 is defined as that area contained within four boundary markers.

Penalty kick positions 46 and 48 respectively are provided directly in front of first and second goal areas 42 and 44, positioned approximately 8 feet directly in front of and mid-way between that end's goal members. Penalties are assessed for unnecessary roughness, charging, tripping, etc.

In fielding players for the method of playing the game of the present invention, obviously, appropriate outer garments and protective padding such as elbow pads and helmets are suggested. When playing the game of the present invention on ice, it is contemplated that each individual player must have a pair of shoes or boots which do not include cleats, spikes or any type of metal gripping member to increase a player's traction. This last exclusion of metal cleats or gripping members on each individual player's boots facilitates a fair distribution of power and speed between all players by limiting each player's overall traction. Likewise, in playing the game of the present invention on a gymnasium floor, rubberized footwear is excluded.

The method of playing the game of the present invention would include the use of a game projectile 10 as described above. The method further includes arranging at least four boundary markers to define a four sided playing area, setting a first pair of goal members on one end of the playing area and second pair of goal members on the opposite end of the playing area. Points would be awarded to a particular team by advancing the game projectile 10 through either the pair of goal members 16 or 18 and into the opponent's goal area 42 or 44. It is contemplated that, as in soccer or hockey, a team advances the projectile toward the opponent's pair of goal members and the other team thus attempts to block that advance, intercept the projectile, and to advance the game projectile toward the opposite pair of goal members. The game is ended by conventional methods such as a predetermined playing time or a predetermined amount of points scored by one team.

While the best mode for carrying out the invention has been described in detail, those familiar with the art to which this invention relates will recognize various alternative designs and embodiments for practicing the invention as defined by the following claims.

What is claimed is:

1. A game projectile comprising:

an energy dissipative core having an irregular shape, said core formed from a plurality of material strips;

a pliant moisture-resistant, cover enclosing said core to form an irregularly-shaped inner body; and a pliant, substantially puncture-resistant, exterior casing enveloping said body, said exterior casing and cover loosely enveloping said core preventing said projectile from rolling when impacted wherein said game projectile has a weight in a range from 2 to 8 pounds.

2. The game projectile as in claim 1 having a weight ranging from 2–5 pounds.

3. The game projectile as in claim 1 wherein said exterior casing loosely envelopes said inner body allowing said projectile to deform when impacted.

4. The game projectile as in claim 1 wherein said energy dissipative core comprises a plurality of fabric strips.

5. The game projectile as in claim 1 wherein said energy dissipative core comprises a plurality of elastomeric strips.

6. The game projectile as in claim 1 wherein said energy dissipative core comprises a plurality of polymeric strips.

7. The game projectile as in claim 1 wherein said cover is made of a polymeric material.

8. The game projectile as in claim 1 wherein said cover is made of an elastomeric material.

9. The game projectile as in claim 1 wherein said cover is made of a laminate material.

10. The game projectile as in claim 1 wherein said cover is made of a composite material.

11. The game projectile as in claim 1 wherein said cover further includes a cover closure and said cover and cover closure are substantially watertight.

12. The game projectile as in claim 1 wherein said exterior casing is made of a fabric material.

13. The game projectile as in claim 1 wherein said exterior casing is made of a fiber based material.

14. The game projectile as in claim 1 wherein said exterior casing is made of a polymeric material.

15. The game projectile as in claim 1 wherein said exterior casing is made of a elastomeric material.

16. The game projectile as in claim 1 wherein said exterior casing and cover are made of a laminate material and said exterior casing portion faces out away from said inner core.

17. The game projectile as in claim 1 wherein said energy dissipative core is approximately 65–90% of the overall weight of the projectile.

18. The game projectile as in claim 1 wherein said cover is approximately 1–6 millimeters thick.

19. The game projectile as in claim 1 wherein said exterior casing is approximately 2–15 millimeters thick.

20. The game projectile as in claim 1 having an overall length ranging from 36 to 42 inches and a girth ranging from 30 to 36 inches.

21. The game projectile as in claim 1 having an overall length ranging from 18 to 24 inches and a girth ranging from 12 to 18 inches.

22. A game projectile comprising:

an energy dissipative core having an irregular shape;

a pliant moisture-resistant, covering closing said core to form an irregularly-shaped inner body; and a pliant, substantially puncture-resistant, exterior casing enveloping said inner body, said exterior casing and cover loosely enveloping said core preventing said projectile from rolling when impacted wherein said game projectile has a weight in a range from 2 to 8 pounds and a horizontal girth ranging from 18 to 42 inches and a vertical girth ranging from 12 to 36 inches.

23. A game projectile as in claim 22 wherein said energy dissipative core comprises a plurality of plastic pellets.

24. A method of playing a soccer-like game on ice between at least a first player and a second player, comprising the steps of:

(a) providing a game projectile comprising an energy dissipative core, a pliant, moisture-resistant cover enclosing said core to form an irregularly shaped inner body, and a pliant, substantially puncture-resistant, exterior casing enveloping said inner body, said exterior casing and cover loosely enveloping said core preventing said projectile from rolling when impacted wherein said projectile has a weight in a range from 2 to 8 pounds;

(b) providing a first goal on a first end of said playing area and a second goal on a second end of said playing area opposite said first side;

(c) advancing said game projectile across said playing area by the use of a player's legs, torso or arms;

(d) awarding points to said first player for moving said game projectile across said playing area through said second goal member; and (e) awarding points to said second player for moving said game projectile across said playing area through said first goal member.

25. A method of playing a soccer-like game on a substantially smooth surface between at least a first player and a second player, comprising the steps of:

(a) providing a game projectile comprising an energy dissipative core, a pliant, moisture-resistant cover enclosing said core to form an irregularly shaped inner body, a pliant, substantially puncture-resistant, exterior casing enveloping said inner body;

(b) defining a playing area using at least four boundary markers;

(c) providing a goal on a first end of said playing area and a second goal on a second end of said playing area opposite said first side;

(d) advancing said game projectile across said playing area by said first player toward a selected one of said first and second goals by the use of a player's legs, torso or arms;

(e) advancing said game projectile across said playing area by said second player toward the other of said first and second goals by the use of a player's legs, torso or arms; and (f) awarding points to a player for moving said game projectile from said playing area through said opponent's selected goal.

* * * * *